United States Patent [19]

Parker

[11] 4,095,349

[45] Jun. 20, 1978

[54] HEAT EXCHANGER FOR CLOTHES DRYER

[76] Inventor: Charles L. Parker, 5499 Elmcrest Ln., Cincinnati, Ohio 45242

[21] Appl. No.: 730,843

[22] Filed: Oct. 8, 1976

[51] Int. Cl.[2] ..... F26B 19/00

[52] U.S. Cl. ..... 34/86; 165/78; 165/95; 165/166

[58] Field of Search ..... 165/166, 167, 165, 78, 165/95; 34/86

[56] References Cited

U.S. PATENT DOCUMENTS

| | | | |
|---|---|---|---|
| 1,960,510 | 5/1934 | Ridgway | 165/166 X |
| 2,623,735 | 12/1952 | Schofield et al. | 165/78 X |
| 2,938,714 | 5/1960 | Gerrish | 34/86 X |
| 3,255,817 | 6/1966 | Davids et al. | 165/167 X |
| 3,859,735 | 1/1975 | Katterjohn, Jr. | 165/128 X |

FOREIGN PATENT DOCUMENTS

| | | | |
|---|---|---|---|
| 630,450 | 8/1927 | France | 165/166 |
| 228,443 | 2/1925 | United Kingdom | 165/166 |
| 466,801 | 6/1937 | United Kingdom | 165/166 |
| 938,088 | 9/1963 | United Kingdom | 165/166 |

*Primary Examiner*—Albert W. Davis, Jr.
*Attorney, Agent, or Firm*—J. Warren Kinney, Jr.

[57] ABSTRACT

The lint and moisture laden hot exhaust gases from a commercial laundry dryer are caused to pass, in a non-obstructed manner through a heat exchange unit through which ambient air is drawn and pre-heated before being introduced to the heating unit of the dryer, thereby effecting a substantial savings in fuel.

20 Claims, 7 Drawing Figures

MOIST LINT-LADEN EXHAUST AIR
AMBIENT AIR
HEATED CLEAN AIR

HEAT EXCHANGER FOR CLOTHES DRYER

BACKGROUND OF THE INVENTION

The operating efficiency of any conventional commercial laundry dryer is substantially increased, with a proportionate decrease in fuel cost by preheating the air entering the heating unit of the dryer. If gas fired, heated air and the products of combustion are directed downwardly through the housing in which a perforated article-receptive drum is rotatably mounted for tumbling the contents of the drum as said contents are being subjected to the drying effect of the heated air and products of combustion, which, having passed downwardly through the housing, are exhausted from the lower end thereof to be discharged into the atmosphere via a suitable flue.

Considerable fuel savings may be effected in those instances in which the lint and moisture laden, hot exhaust gaseous media are utilized for preheating ambient air which is then introduced into the combustion chamber.

DESCRIPTION OF THE PRIOR ART

U.S. Pat. No. 3,969,070 discloses a typical heat saver for a commercial clothes dryer, wherein a portion of the lint and moisture laden exhaust gases are diverted back toward the combustion chamber in such a manner as to pre-heat the ambient air which is introduced to the combustion chamber, whereby to be intermixed with and then recirculated through the dryer housing for effecting a savings in fuel. A serious objection to the device of U.S. Pat. No. 3,969,070 resides in the fact that appreciable quantities of lint and moisture laden products of combustion are recirculated through the housing, the rotating chamber and the articles within the rotating chamber which are being dried.

The prior art includes heat exchange units for clothes dryers, wherein ambient air is drawn through a plurality of tubes, the outer surface of which comprise a tortious passageway for the spent, lint and moisture laden, hot exhaust gases. The structural details of said devices are such that it is extremely difficult, if not impossible to inspect and, if necessary, clean the tubes of the crud deposited thereon from the lint and moisture laden exhaust gases as they pass around the ambient air tubes.

The prior art likewise includes heat exchange units of the type which include an elongate, tubular housing within the exhaust stack, wherein the bottom end of an inner housing is provided with a baffle plate in spaced relationship with respect to the lower end of said housing whereby to theoretically lessen the amount of lint particles which, but for the presence of said baffle, would be reintroduced into the combustion chamber of the dryer.

SUMMARY OF THE INVENTION

The invention is directed to the structural details of a heat exchange unit which is adapted to effectively and efficiently utilize the heat contained in the lint and moisture laden exhaust gases discharged from a commercial clothes dryer to preheat clean, ambient air which is introduced into the dryer in advance of, or at the heating unit thereof, for effecting a substantial saving in the amount of energy required to operate the dryer.

The heat exchange unit comprises a housing in which a plurality of pairs of heat transfer plates are securely though removably mounted, wherein said places define a plurality of sets of alternating first and second passageways, wherein the lint and moisture laden exhaust gases pass upwardly through the first set of passageways, and wherein clean, ambient air is drawn into and caused to pass through the second set of passageways, en route to the heating unit of the dryer.

The individual plates, pairs of which collectively define the first and second set of passageways, are rectangular in shape and may be readily removed from the housing for the purpose of inspection, cleaning, replacement or the like with a minimum loss of time and expense.

The unit is light weight, and, if desired, may be associated with a conventional clothes dryer by suspending the unit from the ceiling, in such a manner as to eliminate the imposition of additional weight onto the framework of a dryer with which the unit is operatively associated.

DESCRIPTION OF THE PREFERRED EMBODIMENTS

Figures 1, 2, 3, 4, 5, 6, 7:
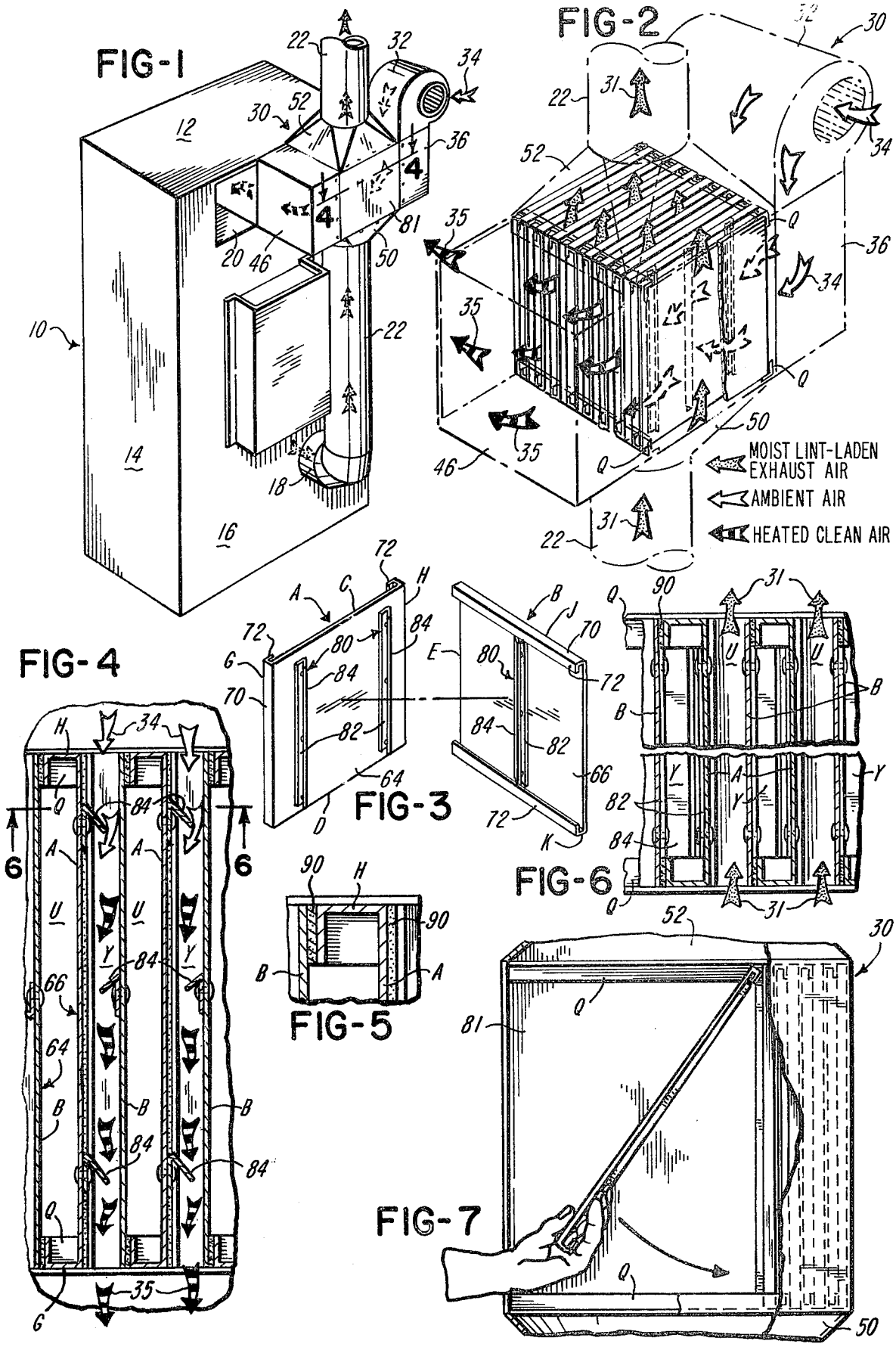
FIG. 1 is a perspective view of the rear portion of a typical commercial clothes dryer with a heat exchange unit of the subject invention operatively associated therewith.
FIG. 2 is an enlarged, perspective view, partly in phantom, illustrating the relationship of the individual sets of alternating first and second passageways which collectively define the heat exchange unit.
FIG. 3 is exploded perspective view of one pair of the heat-transfer plates from which the various passageways of the unit are fabricated.
FIG. 4 is an enlarged, fragmental view of the various sets of passageways, taken on line 4—4 of FIG. 1.
FIG. 5 is an enlarged, fragmental view of a portion of FIG. 4 illustrating the relationship of the gasket material to the plates which collectively comprise a pair to define a passageway.
FIG. 6 is a sectional view taken on line 6—6 of FIG. 4.
FIG. 7 is a fragmental view looking into the left side of the unit of FIG. 1 with parts thereof broken away, for illustrating the manner in which the heat-transfer plates are associated within the central portion of the housing.

FIG. 10 denotes generally, a typical, commercial clothes dryer having a top wall 12, side wall 14, and rear wall 16. A rotatable, article-receptive, perforated drum (not illustrated) is rotatably journaled within the housing at a location beneath a conventional heating unit (not illustrated) adjacent top wall 12, and above exhaust conduit 18, which as illustrated in FIG. 1, projects from the lower portion of the rear wall 16 of the dryer.

The numeral 20 indicates an air intake in the housing for the introduction of ambient air which is heated by means of the above-mentioned heating unit, then directed downwardly of the housing, through and around the drum, and its contents and then discharged from the housing through exhaust conduit 18. The present invention is neither directed to, nor concerned with, the specific structural details of the dryer and/or the particular type of air-heating unit utilized, which unit, in some instances may be electrical, and in other instances may be gas-fired. The material which is discharged via conduit 18 may be described as lint and moisture laden, hot exhaust gaseous media.

The present invention is directed to and concerned with the lint and moisture laden hot exhaust, gaseous media which is discharged via conduit 18, and the particular manner in which such lint and moisture laden, hot gaseous exhaust media is utilized to preheat at least a portion of the ambient air which is thereafter recirculated through the dryer.

The numeral 22, denotes generally a conventional flue stack, the lower end of which is in open communication with exhaust conduit 18.

The heat exchange unit, 30, of the present invention, includes means such as, by way of example, a fan, or the like, 32, by which ambient air, indicated by headed arrow 34, is drawn into the inlet chamber 36, thence transversely between certain pairs of heated heat-conductive plates within the central portion of the unit, into outlet chamber 46, and thence via opening 42 into the air intake 20 of the dryer 10.

Unit 30 includes a central area, intermediate side inlet and outlet chambers 36 and 46, in which central area pairs of rectangular plates are mounted whereby to provide a plurality of sets of first passageways for the lint and moisture laden, hot exhaust, gaseous media from the dryer and the plurality of sets of second passageways for the ambient air.

The unit also includes a first set or pair of inlet and outlet ports 50 and 52, which are in open communication with the open upper and lower edges of the sets of first passageways. Chambers 36 and 46 are disposed in open communication with the open side edges of the sets of second passageways, and those portions of chambers 36 and 46 which are immediately adjacent the sides of the central area of the housing are, for the purpose of this application, and claims, considered to be inlet and outlet ports, respectively, which are in open communication with the open side edges of the sets of second passageways.

As illustrated in FIG. 2, the passageways for the lint and moisture laden, hot exhaust gases are disposed in vertical alignment, said passageways being defined by a plurality of laterally spaced pairs of rectangular heat-exchange plates.

Passageways for ambient air are disposed at substantial right angles with respect to direction of travel of the exhaust gases, that is, the ambient air is caused to pass in a transverse, horizontal direction through unit 30.

With particular reference now to FIG. 3, it will be noted that each pair of conductor plates, A & B, are flat and rectangular in shape, each having a planar front surface 64 and a planar rear surface 66. Each of said plates may be fabricated from any suitable material which is characterized by a high coefficient of thermal conductivity.

The upper and lower edges C & D of one plate of each pair such as, by way of example, plate A, and the side edges E & F of the other plate, B, are wholly unobstructed, whereas, the side edges of G & H of plate A and the upper and lower edges J & K of plate B are provided with elongate spacers means which, if desired, may be formed integral with the corresponding edges of their respective plates. As illustrated, the various spacer means are defined by out-turned portions 70 which project rearwardly and thence inwardly as at 72, in substantial spaced parallelism with rear surfaces 66 of their respective plates, for thereby defining continuous, elongate abutments.

In the preferred embodiment of the invention, the rear surface 66 of plate A is disposed in spaced parallelism with the front surface 64 of a plate B, for thereby defining a first passageway, the upper and lower ends of which are open and the side edges of which are closed.

The rear surface 66 of plate B is disposed in spaced parallelism with the front surface 64 of plate A, for thereby defining a second passageway, the upper and lower edges of which are closed and the said ends of which are open.

Plate B is spaced from plate A by the abutments of plate B which extend along its upper and lower edges J & K, whereas plate A is spaced from plate B by the abutments of plate A long its side edges G & H.

As best illustrated in FIGS. 2 & 7, suitable means are provided for engaging the four corners of each of the individual plates A and B which are alternately stacked within the central portion of unit 30. Satisfactory results have been obtained in those instances in which four elongate L-shaped channels Q are mounted within the central portion of the housing wherein the axis of said channel is at right angles with respect to the direction of flow of the ambient air through the housing of unit 30.

The housing includes a removable central, forward wall 80, which, when removed provides an access opening 81, FIG. 7, into the central portion of the unit for accommodating the arm and hand of an operator incident to the sequential insertion or removal of the individual plates from the central portion of the housing.

In the preferred embodiment of the invention, suitable strips 90 of gasket material are applied to those portions of the abutment members which are disposed in contacting relationship with an edge-adjacent surface of an adjacent plate, for thereby preventing the escape of media from the first set of passageways through which the hot lint and moisture laden exhaust gases are passed into the passageways of the second set, through which the ambient air passes.

With particular reference now to FIG. 4, the areas indicated by the letter U, designates the first set of passageways for the lint and moisture laden, hot exhaust gaseous media. These first passageways are defined by the adjacent, laterally spaced, smooth, flat, uninterrupted front surfaces 64 of plates B and the smooth, flat, uninterrupted rear surfaces 66 of plates A. It should be understood that in FIG. 4 the hot gaseous exhaust media is coming up out of the paper, whereas, the ambient air as indicated by the headed arrows 34 and 35 is passing through the second set of passageways Y, in a direction at substantial right angles to the direction of the hot gaseous media passing through the first set of passageways U.

Suitable deflector means are provided in or on the front surface 64 of plates A and in or on the rear surface 66 of plates B for imparting a tortious flow-path to air passing between said plates. The deflector means, by way of example, may comprise elongate V-shaped strips 80, one leg 82 of which is integral with or suitably secured to front surface 64 of plate A in a direction transverse to the direction of flow of air between said panels.

In FIG. 3, a pair of elongate V-shaped deflector means have been illustrated as secured to and carried by the forward surface 64 of plate A whereas a single elongate V-shaped deflector member has been illustrated to as secured and carried by rear surface 66 of plate B.

As illustrated in FIG. 4, the second, inclined leg 84 of each of the deflector means are disposed at a suitable angle for causing the air, being drawn through the second set of passageways Y to assume a tortious path through their respective passageways for thereby enhancing the heat-transfer characteristics of the first set of passageways, U, whereby the temperature of the air as it passes through the second set of passageways, Y, will be substantially increased, from an ambient temperature at compartment to 36 to a temperature in the neighborhood from 140°-150° F. in chamber 46.

The heated air from chamber 46 is introduced via opening 20 into the upper portion of the clother dryer in such a manner as to supply a preheated portion of the heated air which passes downwardly through the dryer.

With particular reference now to FIGS. 2 and 7, it will be noted that the four corners of the plate-receptive, center portion of the housing, are defined by four angle irons Q, for engaging the four corner adjacent portions of each of a plurality of alternate plates A and B. It should be understood that if the first plate to be inserted into the central portion of the housing is plate B followed by plate A, the spacing between the forward wall 64 of plate A and rear wall 66 of plate B will define a passageway Y for the passage of ambient air.

It should be understood that the abutment-forming in-turned side edges of plate A are adapted to abuttingly engage the entire height of forward surface 64 of the next adjacent plate B and it will be further noted that the abutment forming in-turned upper and lower edges of plate B are adapted to engage the entire width of forward surface 64 of plate A immediately adjacent the ends of abutment members 80. It will also be noted that the length of abutment members 80 are less than the overall height dimension of plate A by a dimension which approximates the vertical spacing between the in-turned portions 72 of said abutment defining means.

With particular reference now to FIGS. 1 and 2, it will be noted that the lint and moisture laden hot exhaust gases, from conduit 18, passing upward through stack 22, will pass in an uninterrupted manner through the first set of passageways, U, as defined by the laterally spaced adjacent surfaces 64 and 66 of adjacent plates A and B.

It will likewise be noted that the ambient air introduced through chamber 36 is caused to pass through the second set of passageways, Y, in a transverse or horizontal, direction, along a tortious or undulating path.

In FIG. 6 the hot gaseous exhaust media as designated by the headed arrows 31 is passing upwardly through the first set of passageways, U, whereas the ambient air is flowing into the paper through the second set of passageways Y.

From the foregoing, it will be noted that I have thus provided a highly efficient heat exchange unit which may be easily associated with the air intake and exhaust ports of a conventional commercial clothes dryer, and which, by reason of its unique construction which utilizes a plurality of pairs of easily removable heat-exchanger plates, can be easily maintained for providing maximum operating efficiency over prolonged periods of time.

None of the lint and moisture laden hot exhaust gaseous media can find its way back into a dryer, however, the structural details of the heat exchange unit are such as to obtain a maximum transfer of heat from the hot exhaust gaseous media to the clean, ambient air which, after heating is introduced into the dryer whereby to effect substantial savings in the cost of energy, whether electric or gas, used to heat the drying-air of the dryer.

What is claimed is:

1. A heat exchanger which utilizes lint and moisture laden hot exhaust gaseous media from a clothes dryer to preheat a portion of the ambient air introduced into a dryer in advance of the heating unit of a dryer, the heat exchanger comprising:

a housing having a first set of inlet and outlet ports for hot exhaust gaseous media and a second set of inlet and outlet ports for the ambient air, wherein the ports of the first set are disposed at substantial right angles with respect to the ports of the second set;

a plurality of flat, rectangular plates within the housing disposed in facially opposed spaced relationship, each plate having spacer means on a pair of opposite side edges thereof, said spacer means covering essentially the entire extent of said opposite side edges, said spacer means each having an abutting means thereon engaging the surface of an adjacent plate for essentially the entire extent of that adjacent plate to define a plurality of first flow channels between said spacer means, spacer means on said adjacent plate abutting a further adjacent plate to form a plurality of second flow channels, said adjacent plates being oriented with regard to each other so that said each plate spacer means are at essentially right angles with said adjacent plate spacer means and said second flow channels are oriented at essentially right angles with regard to said first flow channels, said first flow channels being in fluid communication with the first set of inlet and outlet ports, said second flow channels being in fluid communication with the said second set of inlet and outlet ports, hot exhaust gaseous media passing through the first passageways being completely isolated from air passing through the second passageways;

plate mounting means on said housing for releasably receiving each of said plates; and an access means on said housing for inserting and removing individual plates into and from said housing.

2. A heat exchanger as called for in claim 1, wherein those plates of a pair which collectively define the first sets of passageways are closed along their respective side edges and open along their respective upper and lower edges, and wherein those plates of a pair, which collectively define the second sets of passageways are closed along their respective upper and lower edges and open along their respective side edges.

3. A heat exchanger as called for in claim 1, wherein the first set of inlet and outlet ports and the sets of first passageways define a vertical path for hot exhaust gaseous media, and wherein the second set of inlet and outlet ports and the sets of second passageways define a horizontal path for ambient air.

4. A heat exchanger as called for in claim 2, wherein the opposite side edges of one of the plates of each pair which collectively define a first passageway, and the top and bottom edges of one of the plates of each pair which collectively define a second passageway are provided with spacer means which extend from corresponding surfaces of said plates to abuttingly engage corresponding edges of the other surface of the next adjacent plate of each pair.

5. A heat exchanger as called for in claim 4, wherein the said spacer means are integral with their respective plates.

6. A heat exchanger, as called for in claim 4, wherein gasket means are interposed between said spacer means and the next adjacent plate engaged thereby.

7. A heat exchanger, as called for in claim 4, wherein the housing includes removable means controlling access to the interior thereof intermediate the two sets of inlet and outlet ports.

8. A heat exchanger, as called for in claim 7, wherein the housing includes plate-supporting means for securely though releasably mounting the plates interiority of the housing.

9. A heat exchanger, as called for in claim 8, wherein the plate-supporting means comprise elongate L-shaped channels, one for each of the four corners of the plates supported thereby.

10. a heat exchanger, as called for in claim 9, wherein the said elongate L-shaped channels extend transversely of the direction of the open side edges of the second set of passageways.

11. A heat exchanger, as called for in claim 1, wherein the second passageways include means providing a tortious path between the sides thereof.

12. A heat exchanger, as called for in claim 11, wherein the means providing the said tortious paths comprise deflectors, alternate ones of which project from one toward the other of each of the pair or plates which, collectively, define the said second passageways.

13. A heat exchanger, as called for in claim 12, wherein the deflectors comprise elongate members which span the second set of passageways in parallelism with their open side edges.

14. A heat exchanger, as called for in claim 1, which includes means for inducing the introduction of ambient air into the second of said inlet ports, through the plurality of sets of second passageways and of discharging the air through the second of said outlet ports.

15. A heat exchanger, as called for in claim 14, which includes means for disposing the first set of inlet and outlet ports and the plurality of sets of first passageways in series relationship with the lint and moisture laden hot exhaust gaseous media from a clothes dryer, and for disposing the second of said outlet ports in open communication with the interior of the dryer in advance of the heating unit thereof.

16. The heat exchanger of claim 1 wherein said spacer means each include a first flange attached to said plate and a second flange attached to said first flange to be in spaced parallelism with said plate.

17. The heat exchanger of claim 1 wherein said plate mounting means includes elongate L-shaped channels each having the longitudinal axis thereof oriented at essentially right angles with regard to said second flow channels.

18. The heat exchanger of claim 1 wherein said access means includes a removable forward wall of said housing.

19. The heat exchanger of claim 1 wherein the other pair of side edges of said each plate are wholly unobstructed.

20. A heat-exchange unit comprising a housing having two sets of inlet and outlet ports therein; a plurality of flat, rectangular plates disposed in said housing in facially opposed spaced relationship, each plate having spacer means on a pair of opposite side edges thereof, said spacer means covering essentially the entire extent of said opposite side edges, said spacer means each having an abutting means thereon engaging the surface of an adjacent plate for essentially the entire extent of that adjacent plate, spacer means on said adjacent plate abutting a further adjacent plate, said adjacent plates being oriented with regard to each other so that said each plate spacer means are at essentially right angles with said adjacent plate spacer means thereby providing a plurality of sets of first passageways closed along their respective side edges and open along their respective upper and lower edges, and a plurality of sets of second passageways closed along their respective upper and lower edges and open along their respective side edges, said first and second passageways being oriented at essentially right angles with respect to each other; wherein the open ends of the first passageways are disposed in fluid communication with one set of the inlet and outlet ports in the housing; wherein the open ends of the second passageways are in fluid communication with the other sets of inlet and outlet ports in the housing; and wherein the interiors of the first and second sets of passageways and their respective inlet and outlet ports are completely isolated from one another; plate mounting means on said housing for releasably receiving each of said plates; and an access means on said housing for inserting and removing individual plates into and from said housing.

* * * * *